US011583105B2

(12) United States Patent
EwaneSobe

(10) Patent No.: US 11,583,105 B2
(45) Date of Patent: Feb. 21, 2023

(54) WALKER DEVICE

(71) Applicant: Jane EwaneSobe, Churchville, NY (US)

(72) Inventor: Jane EwaneSobe, Churchville, NY (US)

( * ) Notice: Subject to any disclaimer, the term of this patent is extended or adjusted under 35 U.S.C. 154(b) by 0 days.

(21) Appl. No.: 17/363,090

(22) Filed: Jun. 30, 2021

(65) Prior Publication Data

US 2022/0240692 A1 Aug. 4, 2022

Related U.S. Application Data

(60) Provisional application No. 63/144,844, filed on Feb. 2, 2021.

(51) Int. Cl.
*A47D 13/04* (2006.01)

(52) U.S. Cl.
CPC ..... *A47D 13/04* (2013.01)

(58) Field of Classification Search
CPC ..... A47D 13/04; A47D 13/08; A63H 7/02; A63H 7/04; A63H 7/06; B62K 9/02
See application file for complete search history.

(56) References Cited

U.S. PATENT DOCUMENTS 1,300,292 A * 4/1919 Oshana ..... A61H 3/04 482/68
1,729,557 A * 9/1929 Stoll ..... A47D 13/043 5/310
4,946,158 A * 8/1990 Olayan ..... A47D 13/04 280/87.051
9,289,077 B1 * 3/2016 Gyasi ..... A47D 13/04
10,383,456 B1 * 8/2019 Gyasi ..... A47D 13/04
10,722,420 B1 * 7/2020 Miller ..... A61H 3/04

FOREIGN PATENT DOCUMENTS

BR 102014030811 A2 * 9/2016
CN 209719703 U * 12/2019
DE 202008014418 U1 * 5/2010 ..... A47D 13/04
FR 2737993 A1 * 2/1997 ..... A47D 13/04

* cited by examiner

*Primary Examiner* — James A Shriver, II
*Assistant Examiner* — Ian Bryce Shelton
(74) *Attorney, Agent, or Firm* — Brennan, Manna & Diamond, LLC

(57) ABSTRACT

The present invention relates to an improved walker device that is used to assist infants and toddlers in learning how to stand or walk. The improved walker has an integral structure and includes a vertical member, a cross member, a longitudinal member, a diagonal support member, a plurality of wheels, and a handle grip. The cross member has wheels at opposite ends and the longitudinal member extends horizontally from the middle of the cross member and has a wheel at the free end. The plurality of wheels work in conjunction to move the walker when forward force is applied to the handle grip. The wheels also ensure smooth movement over a floor surface, allowing the child to walk independently under adult supervision. The improved walker may have adjustable braking pads and/or wheels with treads for traction to control the speed of the improved walker.

6 Claims, 3 Drawing Sheets

WALKER DEVICE

CROSS-REFERENCE TO RELATED APPLICATION

The present application claims priority to, and the benefit of, U.S. Provisional Application No. 63/144,844, which was filed on Feb. 2, 2021 and is incorporated herein by reference in its entirety.

FIELD OF THE INVENTION

The present invention relates generally to the field of baby walkers. More specifically, the present invention relates to an improved walker with a handle used to aid infants and small children in learning how to walk. The improved walker device features three durable wheels that are designed to roll across the floor surface when force is applied to the handle acting in the forward direction and ensure a smooth movement over a floor surface, thereby allowing the child to walk independently under adult supervision. Accordingly, the present disclosure makes specific reference thereto. Nonetheless, it is to be appreciated that aspects of the present invention are also equally applicable to other like applications, devices and methods of manufacture.

BACKGROUND OF THE INVENTION

By way of background, an infant typically begins learning how to stand up or walk around the age of 7-12 months. While trying to learn to stand up or walk, the infant starts by holding onto nearby objects to provide support. Once the infant learns how to stand up by holding onto nearby objects for support, he or she gradually builds enough strength in his or her legs to stand alone. However, the infant may not be able to easily reach nearby objects for support, standing or walking. Once the infant learns how to stand up, the parents can assist in learning how to walk by holding the infant's hand. In addition, the infant's parents need to provide encouragement and positive support so the infant can easily learn this skill. This requires a great deal of attention and time from parents until the infant has mastered how to stand and walk independently.

Infants and young children learning how to walk can have difficulty when trying to stand up on their own since they are still learning how to balance and stabilize themselves. Without a proper support structure to grab onto, the infants may sometimes fall down and get injured as well. Additionally, when the parents assist their children in standing up or walking, they must carry their child and hold them upright while they learn how to use their legs. A child's legs may be too weak for them to stand upright on their own without any additional assistance. In this case, when the child's legs are unable to develop proper strength, it may have adverse effects on the child in their later life.

The process of learning how to stand and walk requires significant time and patience from both the infant and the parents. The parents may easily get frustrated while helping their child in standing up or walking, as they must leave their current task each time the child tries to stand up or walk. Due to this, people may find it difficult to get back to their task and complete it, as there may be frequent gaps. The infant may also get frustrated since there are not always objects nearby to hold onto when trying to stand up or walk. For example, if a walker is being used, the child typically will need a parent's support to hold onto the walker, and then parental supervision as the child walks using the walker, side by side.

Therefore, there exists a long-felt need in the art for a device that provides infants and toddlers with a walker device that can assist them when attempting to stand up. There is also a long felt need in the art for a device that can help infants learning to walk as well. Additionally, there is a long felt need in the art for a device that eliminates the need of requiring nearby objects for use as a support when infants are learning to stand up and walk. Moreover, there is a long felt need in the art for a device that helps in strengthening the infant's legs while assisting them in standing up and walking. Further, there is a long-felt need in the art for a device that does not require constant assistance from the infant's parents when learning how to stand up and walk. Furthermore, there is a long-felt need in the art for a walker device that can be conveniently used by the infant with minimal supervision by parents. There is a long-felt need in the art for a walker device that provides a comfortable support for the infant to grasp while attempting to stand up or walk. There is a long-felt need in the art for a walker device that can be easily moved on a floor surface, thereby helping the infant to quickly learn how to stand up and walk. Finally, there is a long-felt need in the art for an improved walker that offers a way for the infant or toddler to walk independently, without having to hold onto a parent's hand for support, which saves time and patience of the parents.

The subject matter disclosed and claimed herein, in one embodiment thereof, comprises an improved walker for assisting infants and toddlers who are learning how to walk comprising of a vertical member, a cross member, a longitudinal member, a diagonal support member, a plurality of wheels, a handle grip and a plurality of braking pads wherein the vertical member is connected to the handle grip at its top end, and is connected to the cross member at its bottom end, the cross member has wheels at opposite ends, the longitudinal member extends horizontally from the middle of the cross member and has a wheel at the free end, each wheel has attached braking pads to control the speed of the wheels, the diagonal support member provides structural support to the vertical member, and is connected between the midpoint of the vertical member and the free end of the longitudinal member, and the improved walker moves when a force is applied to the handle grip in a forward direction. The cross member and the longitudinal member form the wheeled base in a triangular formation, wherein the longitudinal member is oriented such that the free end that includes a wheel is in the forward direction of motion. The wheels ensure smooth movement on a floor surface, allowing the child to walk independently, under adult supervision.

In this manner, the improved walker of the present invention accomplishes all of the foregoing objectives, and provides a relatively safe, easy, convenient and efficient solution to help and assist infants and toddlers in learning how to stand up and walk. The novel walker device of the present invention provides a comfortable handle that the infant may grasp while using the walker (with parental supervision at all times), which provides support and stability to the infant when attempting to stand up or walk.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises an improved walker used to assist infants and toddlers when learning to stand up and walk, comprising of a vertical member, a cross member, a longitudinal member, a diagonal support member, a plurality of wheels, a handle grip and a plurality of braking pads wherein the vertical member is connected to the handle grip at its top end and is connected to the cross member at its bottom end, the cross member has wheels at opposite ends, the longitudinal member extends horizontally from the middle of the cross member and has at least one wheel at the free end, each wheel has attached braking pads to control the speed of the wheels, the diagonal support member provides structural support to the vertical member and is connected between the midpoint of the vertical member and the free end of the longitudinal member, and the improved walker moves when a force is applied to the handle grip in a forward direction. The cross member and the longitudinal member form the wheeled base in a triangular formation wherein the longitudinal member is oriented such that the free end that includes at least one wheel is in the forward direction of motion. Additionally, one or more wheels could also be placed at the connection point of the crossmember, vertical member, and the longitudinal member for added structural support. The wheels ensure smooth movement on a floor surface, allowing the child to begin to learn to walk independently.

In a further embodiment of the present invention, an improved walker used to assist infants and toddlers when learning to stand up and walk comprising of a vertical member, a cross member, a longitudinal member, a diagonal support member, a plurality of wheels, a handle grip and a plurality of braking pads wherein the vertical member is connected to the handle grip at its top end and is connected to the cross member at its bottom end, the cross member has a wheel at each opposite end, the longitudinal member extends horizontally from the middle of the cross member and has a wheel at the free end, each wheel has attached braking pads to control the speed of the wheels, the diagonal support member provides structural support to the vertical member and is connected between the midpoint of the vertical member and the free end of the longitudinal member, and the improved walker moves when a force is applied to the handle grip in a forward direction. The cross member and the longitudinal member form the wheeled base in a triangular formation wherein the longitudinal member is oriented such that the free end that includes a wheel is in the forward direction of motion. The wheels ensure smooth movement on a floor surface, allowing the child to begin to learn to walk independently, under adult supervision.

In one embodiment of the present invention, the vertical member and the inclined arm may have telescoping means to adjust the height of the walker. During use of the walker, the child remains upright with feet on the ground and standing in a stable manner. To control the speed of the wheels, the braking pads frictionally engage with each corresponding wheel, and may be individually adjusted to provide varying degrees for frictional resistance. The frictional brakes may need to be adjusted from time-to-time, based on the size and on the walking-ability of the toddler. The length of the cross member is long enough to stabilize the infant so that he or she does not fall to either side, thus allowing the infant to stand and walk safely.

The improved walker of the present invention provides infants and toddlers with a walker system that keeps the child upright when learning to walk. The novel walker enables the child to grasp onto a comfortable handle and move across the floor using the walker. The wheels ensure smooth movement on a floor surface, and that can be controlled by the adjustable braking pads and/or traction on the wheels. The improved walker of the present invention provides independence to the toddler while learning to walk, thus giving him or her a sense of confidence and improved self-esteem.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
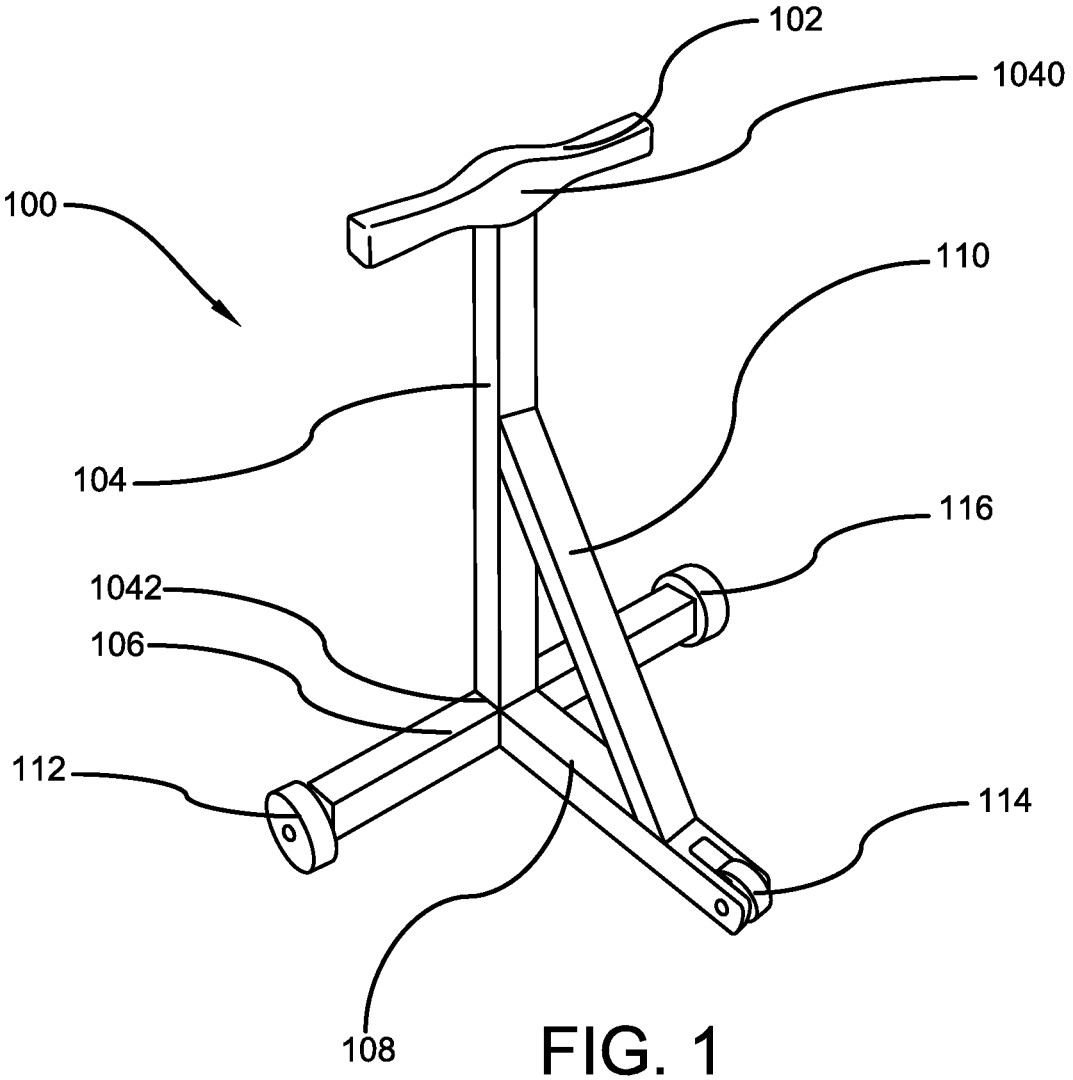
FIG. 1 illustrates a perspective view of one potential embodiment of the improved walker device of the present invention in accordance with the disclosed structure.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for a device that provides infants and toddlers with a walker device that can assist them when attempting to stand up, and that can help infants learning to walk as well. Additionally, there is a long felt need in the art for a device that eliminates the need of requiring nearby objects for use as a support when infants are learning to stand up and walk, and that helps in strengthening the infant's legs while assisting them in standing up and walking. Moreover, there is a long-felt need in the art for a walker device that does not require constant assistance from the infant's parents when they are learning how to stand up and walk, and that can be conveniently used by the infant with supervision from his or her parents. Furthermore, there is a long felt need in the art for a walker device that provides a comfortable support for the infant to grasp while attempting to stand up or walk, and that can be easily moved across a floor surface, thereby helping the infant to quickly learn how to stand up and walk. Finally, there is a long-felt need in the art for an improved walker that offers a way for the infant or toddler to walk independently without having to hold onto a parent's hand for support, which saves time and patience of the parents.

The present invention, in one exemplary embodiment, is an improved walker used to assist infants and toddlers when learning to stand up and walk comprising of a vertical member, a cross member, a longitudinal member, a diagonal support member, a plurality of wheels, a handle grip and a plurality of braking pads wherein the vertical member is connected to the handle grip at its top end, and is connected to the cross member at its bottom end, the cross member has a wheel at each opposite end, the longitudinal member extends horizontally from the middle of the cross member and has a wheel at the free end, each wheel has attached braking pads to control the speed of the wheels, the diagonal support member provides structural support to the vertical member and is connected between the midpoint of the vertical member and the free end of the longitudinal member, and the improved walker moves when a force is applied to the handle grip in a forward direction. The cross member and the longitudinal member form the wheeled base in a triangular formation wherein the longitudinal member is oriented such that the free end that includes a wheel is in the forward direction of motion. The wheels ensure smooth movement on a floor surface, allowing the child to begin to learn to walk independently, under adult supervision.

Referring initially to the drawings, FIG. 1 illustrates a perspective view of one potential embodiment of the improved walker of the present invention in accordance with the disclosed structure. The improved walker 100 includes a handle grip 102 used to assist infants and toddlers in learning how to stand up or walk. The handle grip 102 is sized accordingly to emulate the hand or finger of the parent, thus giving the infant an object to gasp ahold of when attempting to stand-up or walk. The improved walker 100 is preferably constructed as a one-piece structure, other than the pivotally-mounted wheels that may be removable. However, it is possibly that the improved walker 100 could be made to fold or disassemble for ease of storage and transportation.

The improved walker 100 has a vertical member 104 attached to a cross member 106 at the junction 1042. The vertical member 104 is attached to the handle grip 102 at a second junction 1040. The cross member 106 has a first wheel 112 and a second wheel 116 on opposite ends. A third wheel 114 is attached to an end of the longitudinal member 108 in the front of the walker 100. The three wheels 112, 114, 116 work in conjunction to move the walker 100 when forward force is applied to the handle grip 102.

To give support and stability to the improved walker 100, a diagonal support member 110 connects the vertical member 104 at the midpoint and the longitudinal member 108 near the third wheel 114. When forward force is applied on the handle grip 102, the diagonal support member 110 gives support to the vertical member 104 such that the vertical member 104 remains stable and does not bend or break. Further, the longitudinal member 108 provides stability to the improved walker 100 when force is applied to the handle grip 102 in the forward direction, preventing it from tipping over.

In the preferred embodiment of the present invention, the vertical member 104 is connected at the middle of the cross member 106. The longitudinal member 108 extends from the same middle point in a front direction and has the third wheel 114 at the other end. In yet another embodiment (not shown), an additional wheel could be placed at junction 1042 for even more structural support.

When the improved walker 100 is pulled by applying force on the handle grip 102, the wheels 112, 114, 116 rotate in conjunction with each other in a rearward motion. The longitudinal member 108 is in perpendicular direction to both the cross member 106 and the vertical member 104. The walker 100 has a triangular formation with the cross member 106 and the longitudinal member 108. The adjustable brake pads, as best shown in FIG. 2, may be selectively configured such that only forward motion is possible, thus preventing the improved walker 100 from being pulled in a rearward direction.

The wheels 112, 114, 116 are pivotally attached to the members of the improved walker 100 and can freely rotate. The wheels may be pivotally-attached to each member using screws, nails or other attachment means. The improved walker 100 does not tip over sideways due to the length of the cross member 106 when it is used by the toddler for standing up or walking.

The improved walker 100 may be constructed from any durable and sturdy material such as wood, alloy or metal, and is preferably made as a one-piece structure, (other than the wheels) without any sharp edges. The wheels 112, 114, 116 are attached to the members, with the option for removal, and work in conjunction with each other for a uniform and smooth movement over a floor surface. In one embodiment, the height of the improved walker 100 may be adjusted using a telescoping mechanism present in the vertical member and/or the inclined handle.

Figure 2:
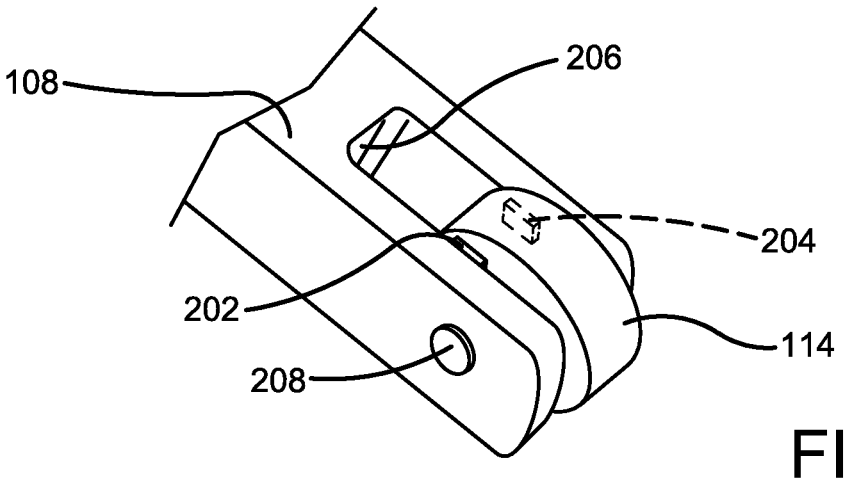
FIG. 2 illustrates an enlarged perspective view of another potential embodiment of the improved walker device showing a wheel and brake pads portion of the present invention in accordance with the disclosed structure.

FIG. 2 illustrates an enlarged perspective view of another potential embodiment of the improved walker showing the wheel and brake pad portion of the present invention in accordance with the disclosed structure. It should be appreciated that the braking mechanism defined in the present embodiment can be applied on any or all of the three wheels 112, 114, 116 of the improved walker 100. The third wheel 114 is pivotally attached to the longitudinal member 108. The longitudinal member 108 has a groove 206 in which the third wheel 114 is placed by preferably screwing it into the side surfaces of the longitudinal member 108 using one or more screws 208. Adjustable brake pads 202, 204 are present along the surfaces of the groove 206 and the brake pads 202, 204 touch the wheel 114 to control the speed of the wheel 114. Similarly brake pads 202, 204 are also present to control the speed of the first wheel 112 and the second wheel 116. The brake pads 202, 204 do not allow the speed of the wheels 112, 114, 116 to increase beyond a certain limit that is essential for the safety of the toddler using the improved walker 100. Additionally, the adjustable brake pads make be selectively configured to allow or prevent rearward motion of the improved walker 100.

The wheels 112, 114, 116 can be removed and easily replaced by removing the screws 208. Each wheel 112, 114, 116 is properly positioned so as to provide a highly stable platform for the improved walker 100. The wheels work in conjunction with each other, along with the braking pads, to give a smooth and controlled motion of the improved walker 100.

In one embodiment, a push button may be present on the grip 102 to activate or deactivate the braking pads. While the walker 100 is not in use, the push button is activated to activate the braking pads. The braking pads of each wheel may be connected by a wired mechanism to the push button (not shown). Further, each wheel may include frictional material and/or a clutch mechanism (neither are shown) that would limit rotational motion about its pivot. This may serve as the braking mechanism, in addition to restricting motion of the improved walker 100 to a forward direction only.

Figure 3:
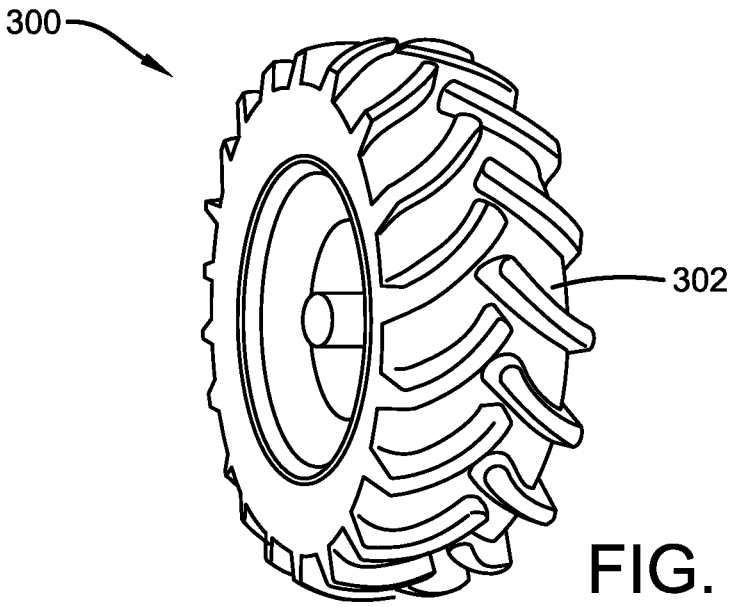
FIG. 3 illustrates an enlarged perspective view of another potential embodiment of the improved walker device showing a wheel including tread used for traction of the present invention in accordance with the disclosed structure.

FIG. 3 illustrates an enlarged perspective view of another potential embodiment of the improved walker showing a wheel including tread used for traction of the present invention in accordance with the disclosed structure. To reduce and control the speed of the walker 100, the wheel 300 may include treads 302 on and around the circumference of the wheel to provide added traction. The wheels 300 with the treads 302 may prevent slipping of the wheels on plain and wet surfaces and offers added rolling resistance between the wheel 300 and the ground. The wheel 300 can be screwed in a similar manner to the bases of the improved walker 100 and can provide a stable movement of the improved walker 100.

Figure 4:
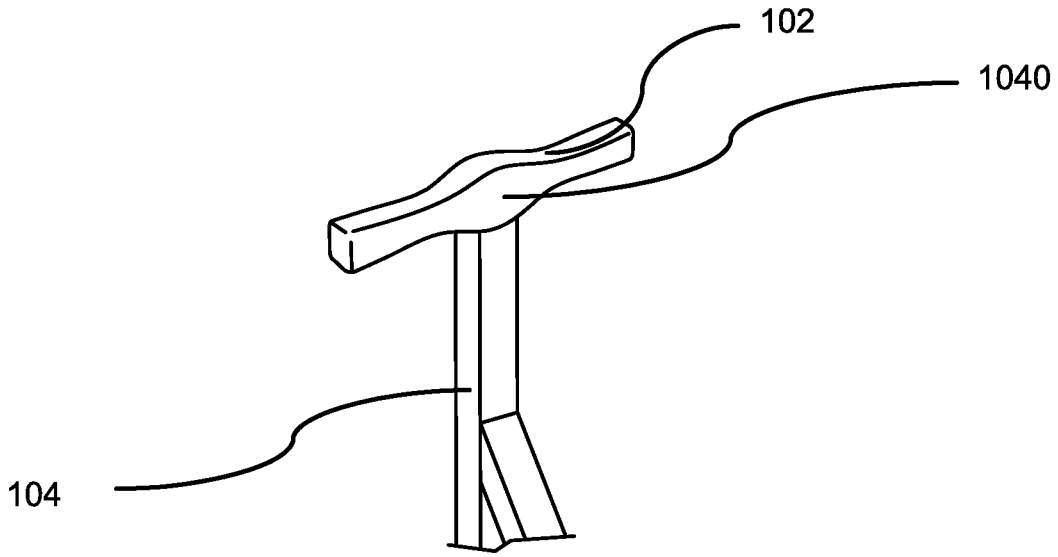
FIG. 4 illustrates an enlarged perspective view of another potential embodiment of the improved walker device showing the handle grip portion of the present invention in accordance with the disclosed structure.

FIG. 4 illustrates an enlarged perspective view of another potential embodiment of the improved walkers showing the handle grip portion of the present invention in accordance with the disclosed structure. The ergonomic, soft handle grip 102 is held by an infant or toddler to engage and operate the toddler walker 100. The handle grip 102 is sturdy and does not tilt or move. The handle grip 102 is joined to the vertical member 104 at the junction 1040.

The handle grip 102 has a length such that both the hands of the toddler are placed onto the handle grip 102. Force on the handle grip 102 in a forward direction moves the improved walker 100 in a forward direction. The handle grip 102 is fixed at the top of the vertical member 104. The handle grip 102 may have a silicon or plastic cover and may have any shape or size. Ideally, the size of the handle grip 102 should be similar to that of a parent's finger or hand so that it is easily gasped by the infant or toddler.

Figure 5:
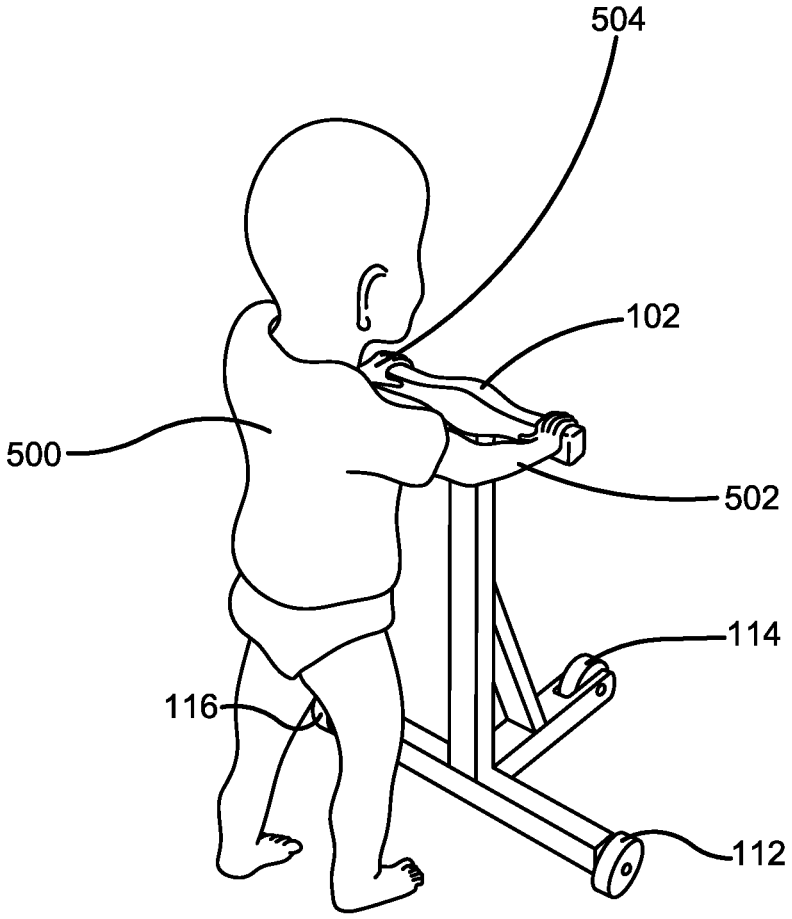
FIG. 5 illustrates a perspective view of an infant using a potential embodiment of the improved walker device of the present invention as per the disclosed structure.

FIG. 5 illustrates a perspective view of an infant using a potential embodiment of the improved walker of the present invention as per the disclosed structure. An infant 500 grasps the handle grip 102 with their hands 502, 504. A comfortable and stable grip is formed and when a slight forward force is applied by the infant 500. The wheels 112, 114, 116 rotate uniformly in conjunction and in a forward direction. The infant 500 stands upright and places his or her hands on the handle grip 102. The wheels ensure smooth movement over a floor surface, allowing the child to walk independently in a stable manner under adult supervision. It should be appreciated that adult supervision is not mandatory since the improved walker 100 does not tip over. The speed of the walker is limited by the traction of the wheels and the brake pads within the braking mechanism, thereby providing safety for the infant or toddler.

The improved walker 100 may come in various sizes to accommodate users of different ages and heights. The improved walker 100 offers a way for a toddler to walk independently, under supervision, without support from a parent or guardian. The improved walker 100 allows infants to stand or move around without fear of falling. The infants also may strengthen their fast-developing muscles as they learn to push and pull by holding on to the improved walker 100. The improved walker 100 is portable and can be easily stored away when not in use.

The wheels are designed such that the improved walker 100 can only move in a forward and rearward direction while providing flexible maneuverability. The improved walker 100 may come in bright and engaging colors with logos and trademarks. The wheels, typically made from plastic or rubber, measure approximately two inches (2") in diameter to rotate easily over most surfaces.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "improved walker" and "improved walker device" are interchangeable and refer to the improved walker 100 of the present invention.

Notwithstanding the foregoing, the improved walker 100 of the present invention can be of any suitable size and configuration as is known in the art without affecting the overall concept of the invention, provided that it accomplishes the above-stated objectives. One of ordinary skill in the art will appreciate that the size, configuration and material of the improved walker 100 as shown in the FIGS. are for illustrative purposes only, and that many other sizes and shapes of the improved walker 100 are well within the scope of the present disclosure. Although the dimensions of the improved walker 100 are important design parameters for user convenience, the improved walker 100 may nonetheless be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features, and embodiments that do not include all of the described features. Accordingly, the scope of the present invention is intended to embrace all such alternatives, modifications and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A walker device comprising:

a vertical member;

a cross member;

a longitudinal member comprising a first end and a second end, wherein the longitudinal member is connected to the cross member at the first end and the second end comprises a groove cut into the second end;

a diagonal support member attached to a midpoint of the vertical member at one end of the diagonal support member and adjacent to the second end of the longitudinal member at the other end of the diagonal support member;

a first wheel attached to a first end of the cross member;

a second wheel attached to a second end of the cross member;

a third wheel pivotally retained within the groove of the longitudinal member;

a handle grip; and a plurality of braking pads positioned within the groove for engaging the third wheel.

2. The walker device as recited in claim 1, wherein the vertical member extends between, and is attached to, each of the handle grip and the cross member.

3. The walker device as recited in claim 2, wherein the plurality of braking pads control operation of the first, second and third wheels.

4. The walker device as recited in claim 3, wherein the cross member and the longitudinal member form a triangular wheel base.

5. The walker device as recited in claim 4, wherein the longitudinal member is oriented such that the free end is in a forward direction when the walker device is in motion.

6. A walker device comprising:

a vertical member;

a cross member attached to the vertical member and extending outwardly therefrom in at least two directions;

a longitudinal member comprising a first end and a second end, wherein the longitudinal member is connected to the cross member at the first end and the second end comprises a groove cut into the second end;

a diagonal support member attached to a midpoint of the vertical member at one end of the diagonal support member and adjacent to the second end of the longitudinal member at the other end of the diagonal support member;

a removable first treaded wheel attached to a first end of the cross member;

a removable second treaded wheel attached to a second end of the cross member;

a removable third treaded wheel pivotally retained within the groove of the longitudinal member;

a handle grip attached to the vertical member and extending outwardly therefrom in at least two directions; and a pair of braking pads positioned within the groove for engaging the removable third treaded wheel, each braking pad positioned on opposite sides of the groove with the removable third treaded wheel disposed between.

* * * * *